US005832898A

United States Patent [19]

Wakeman

[11] Patent Number: 5,832,898

[45] Date of Patent: Nov. 10, 1998

[54] FUEL INJECTION SYSTEM WITH PRESSURE DECAY METERING METHOD

[75] Inventor: Russell J. Wakeman, Canton, Mich.

[73] Assignee: Siemens Automotive Corporation, Auburn Hills, Mich.

[21] Appl. No.: 870,153

[22] Filed: Jun. 5, 1997

[51] Int. Cl.[6] ..... F02M 37/04

[52] U.S. Cl. ..... 123/447; 123/508

[58] Field of Search ..... 123/446, 447, 123/458, 508, 509, 495

[56] References Cited

U.S. PATENT DOCUMENTS

| | | | |
|---|---|---|---|
| 2,055,578 | 9/1936 | Hurst . | |
| 4,100,904 | 7/1978 | Eckert et al. | 123/453 |
| 4,419,977 | 12/1983 | Hillebrand . | |
| 4,615,323 | 10/1986 | LeBlanc et al. . | |
| 4,622,942 | 11/1986 | Nozaki et al. . | |
| 4,718,384 | 1/1988 | Takahashi . | |
| 5,161,496 | 11/1992 | Matsushima et al. . | |
| 5,176,120 | 1/1993 | Takahashi | 123/447 |
| 5,257,606 | 11/1993 | Willman et al. . | |
| 5,323,750 | 6/1994 | Rotter . | |
| 5,477,833 | 12/1995 | Leighton . | |
| 5,577,479 | 11/1996 | Popp . | |
| 5,771,865 | 6/1998 | Ishida | 123/447 |

*Primary Examiner*—Thomas N. Moulis

[57] ABSTRACT

A fuel injection system for an engine having exhaust valve train drive means includes a compression spring connected to the exhaust valve train drive member for compression and expansion movement with the drive member. A diaphragm fuel pump includes a pumping chamber having a pump diaphragm driven by a compression spring. The pumping chamber includes a fuel inlet passage having a check valve therein. An injector chamber, in fuel flow communication with the pumping chamber, receives fuel from the pumping chamber during compression and expansion cycling of the compression spring. The injector chamber includes an accumulator and connects with a fuel injector. A check valve is disposed between the chambers prevents fuel flow back into the pumping chamber. A pressure sensor is mounted for sensing fuel pressure in the injector chamber and operates to communicate the fuel pressure value in the injector chamber. An engine controller receives the fuel pressure value of the fuel pressure in the injector chamber and controls fuel metering based upon the reduction in fuel pressure in the injector chamber during engine fuel injection. A timing member is in communication with the engine controller for initiating fuel injection.

16 Claims, 1 Drawing Sheet

FUEL INJECTION SYSTEM WITH PRESSURE DECAY METERING METHOD

FIELD OF THE INVENTION

This invention relates to fuel delivery systems and more particularly to a fuel injection system wherein a diaphragm type fuel pump is driven by a feature in an engine's exhaust valve train, and fuel metering, through a fuel injector, is a function of a reduction of fuel pressure in an injector chamber of the fuel pump during engine fuel injection.

BACKGROUND OF THE INVENTION

It is known in the art relating to vehicle fuel injection systems to use an electrical fuel supply pump and some means of pressure regulation to provide a constant pressure across an electrical injection valve. Such pressure regulation means typically include either a bypass or a throttling diaphragm and spring regulator, referenced to manifold pressure. This constant pressure allows the injector to be accurately calibrated for static and dynamic flow rates to enable an electronic controller in the system to meter fuel accurately. This is done by measuring or calculating airflow, computing an appropriate fuel flow, and opening the injection valve for a pulse width which implies a fuel flow by virtue of the known calibration of the injector.

However, for small utility engines, this system is extremely expensive by virtue of the extensive number of components in the system, and the accuracy necessary and built into the metering components, i.e. regulator and injector; sensing components for MAP, airflow and camshaft position; and the fuel pressure supply pump.

SUMMARY OF THE INVENTION

The present invention provides a fuel injection system wherein injector calibration is not a factor in the metering of the system thus reducing the required accuracy of the system components and thereby the cost of such a system. The fuel injection system disclosed herein utilizes a diaphragm type fuel pump, where fuel metering is a function of the change in pressure in an injector chamber as fuel is injected into an engine.

According to the invention, the fuel injection system is used with an engine having exhaust valve train drive means such as an exhaust cam lobe. The system includes a compression spring connected to the exhaust valve train drive means for compression and expansion movement. The system also includes a diaphragm fuel pump having a pumping chamber and an injector chamber in fuel flow communication. The pump diaphragm is driven by the compression spring and pumps fuel from a fuel tank, usually at a higher elevation and operating under the force of gravity, into the injector chamber. The pumping chamber includes a fuel inlet passage having a check valve through which fuel is received from the tank.

The injector chamber receives fuel from the pumping chamber during compression and expansion cycling of the compression spring by the valve train drive means which moves the diaphragm. The injector chamber includes a spring accumulator, or other type of pressure accumulator, and connects with a fuel injector. A check valve is disposed between the pumping and injector chambers to prevent fuel flow back into the pumping chamber. A pressure sensor is mounted for sensing fuel pressure in the injector chamber and operates to communicate the fuel pressure value in the injector chamber. An engine controller receives the fuel pressure value of the fuel pressure in the injector chamber and controls fuel metering based upon the reduction in fuel pressure in the injector chamber during engine fuel injection. Timing means in communication with the engine controller initiates fuel injection.

The timing means may include a crankshaft position sensor and/or a camshaft position sensor. In one embodiment the crankshaft position sensor is a crankshaft toothed wheel sensor including a magnetic pickup electrically connected to the engine controller.

Preferably, the pressure sensor is a pressure transducer that communicates a voltage proportional to pressure in the injection chamber to the engine controller. Also, a throttle position sensor and engine temperature sensor are electrically connected to the engine controller.

These and other features and advantages of the invention will be more fully understood from the following detailed description of the invention taken together with the accompanying drawings.

DETAILED DESCRIPTION OF THE INVENTION

Figure 1:
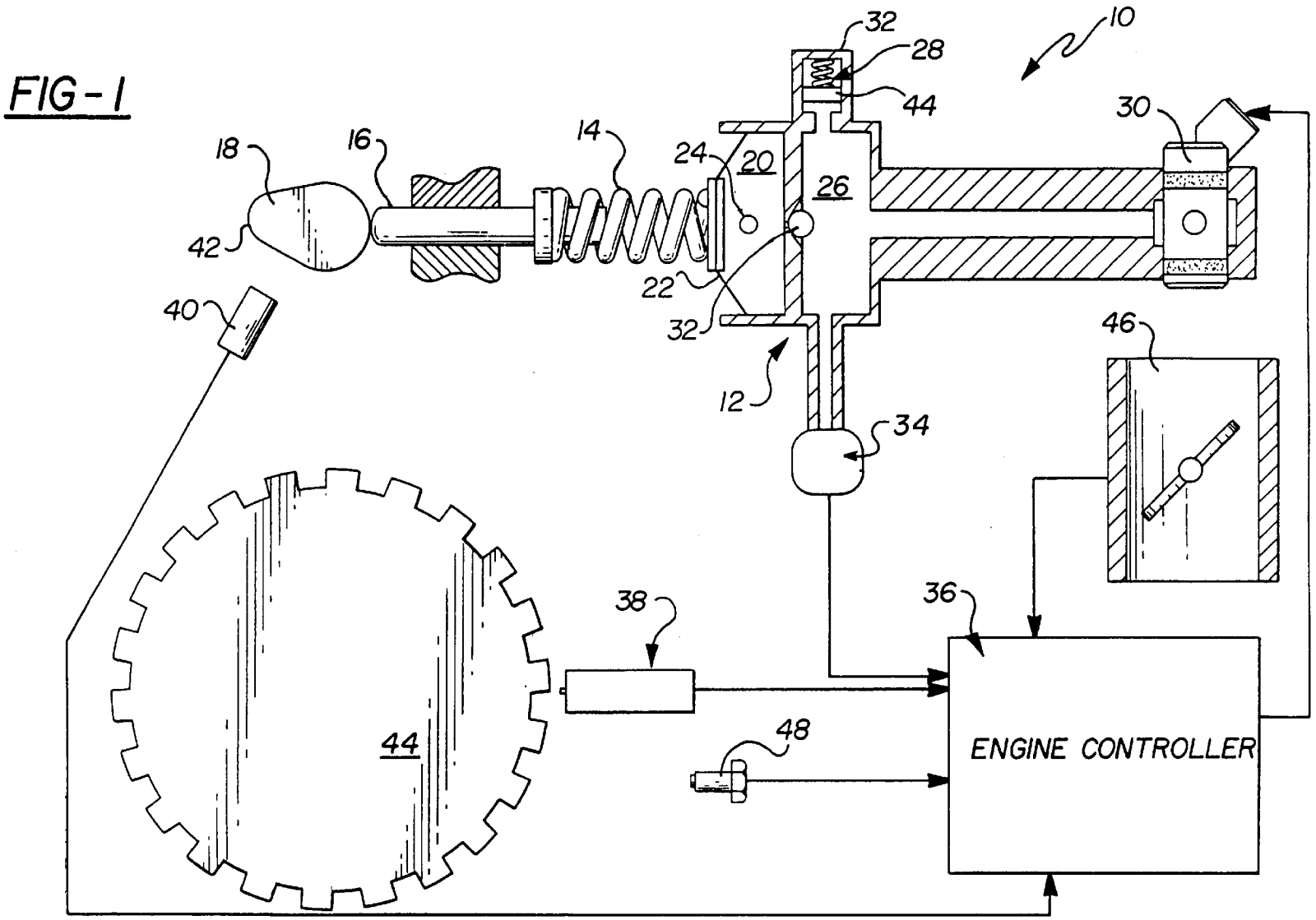
FIG. 1 is a schematic view of a fuel injection system using a pressure decay metering method constructed in accordance with the present invention.

Referring now to the drawing in detail, numeral 10 generally indicates a fuel injection system that provides for fuel delivery based upon system pressure changes. As is hereinafter more fully described, the system 10 eliminates the necessity of fuel injector calibration.

FIG. 1 illustrates a diaphragm type fuel pump 12 driven by a compression spring 14 connected to a push rod 16 driven by the engine's exhaust cam lobe 18. Fuel pump 12 includes a pumping chamber 20 having a pump diaphragm 22 driven by the compression spring 14. The pumping chamber 20 includes a fuel inlet passage 24 having a check valve therein. An injector chamber 26, in fuel flow communication with the pumping chamber 20, receives fuel from the pumping chamber during compression and expansion cycling of the compression spring 14. The injector chamber 26 includes an accumulator 28, and connects with a fuel injector 30. A check valve 32 disposed between the chambers 20,26 prevents fuel flow back into the pumping chamber.

In the illustrated embodiment, the exhaust valve train drive means is the exhaust cam lobe 1 8 although other convenient points in the exhaust valve train can also be utilized. The exhaust valve train drive is used since it will create a pressure pulse which will be used for fuel metering just prior to the opening of an associated intake valve, which is an appropriate time to build pressure for a subsequent injection of fuel. In system 10, the fuel for each injection pulse is pressurized just before its corresponding injection. The push rod 16 drives the pump diaphragm 22 through the compression spring 14, so that an overpressure condition can be absorbed by compression of the spring, thus insuring that the injector chamber 26 is never overpressurized beyond the burst pressure of the diaphragm 22.

The pump diaphragm 22 closes the pumping chamber 20 which is fed, optionally by gravity, from a fuel supply tank, not shown, at a higher elevation through a passage 24 equipped with a check valve to prevent fuel outflow back to the tank during the pressurization stroke. The pumping chamber 20 pumps fuel to the injector chamber 26, also through a check valve 32, which flows outward, but not back during the return stroke of the diaphragm 22.

The injector chamber 26 includes accumulator 28 illustrated as a spring accumulator. Other accumulators such as of a piston, gas bladder, or diaphragm type construction can be utilized. Diaphragm 22 travels outwardly to fill the pumping chamber 20. Thereafter, an amount of fuel is delivered to the injector chamber by inward motion of the diaphragm during the motion of the cam lobe 18 causing push rod 16 movement in a pumping stroke. During the time of the pumping stroke, the injector 30 is kept closed. As fuel is forced into the injector chamber 26 and the accumulator 28 absorbs it, the compression of an accumulator spring 32 raises the pressure in the chamber 26. This pressure change is registered by a pressure sensor 34, preferably a pressure transducer, which connects to the injector chamber 26, and communicates a voltage proportional to the pressure in the injector chamber 26 to an engine controller 36.

The engine controller 36 uses this pressure information for two purposes, for fuel metering and for engine position information. In a conventional system, engine position information is provided by the combination of a crankshaft toothed wheel sensor 38, for accurate crank position information, and by a camshaft position sensor 40 of less accuracy. The camshaft sensor 40 provides information (on a four-stroke cycle engine) as to whether the crankshaft TDC marker is indicating a compression TDC or an exhaust TDC, which are indistinguishable by the crankshaft sensor 38. In the case of system 10, the peak of the fuel pressure reading in the injector chamber 26 is an indication of the position of the nose 42 of the exhaust cam lobe 18, since the cam is used to drive the pump diaphragm 22.

The second function of the pressure sensor 34 is to determine the metering rate of the injector 30. Since the accumulator 28 is of known piston area, the movement of the piston 44 is an indication of the volume of fuel entering or leaving the injector chamber 26. Entering fuel quantity is of no great interest, but fuel quantity leaving the chamber 26 is a measure of the fuel quantity being delivered to the engine. Motion of the accumulator piston 44 and compression of its spring 32 are measurable as a change in the pressure in the injector chamber 26 since the spring force divided by the accumulator piston area represents the pressure of the fuel in the chamber. This pressure change can be used to determine the amount of fuel leaving the chamber 26 during an injection of fuel into the engine.

A pressure reading taken before the start of injection, less the pressure reading after injection equates to the volume of fuel which left the chamber 26 between readings. More frequent readings during the injection event can be integrated by the engine controller 36 to provide a running total of fuel delivered during one injection. It is then possible to initiate an injection, integrate the delivered fuel until the desired quantity is reached, and then shut off the injector 30. It has been found that a finite amount of fuel above the desired level is injected during shutoff, but this quantity is also measurable by this technique.

Previous injections allow calculation of the flow delivered between electrical shutoff and close of the injector 30. This offset is subtracted from the desired total before it is compared to the fuel delivered at each time step during the injection. Such independence from opening and closing time considerations allow cost reduction in injector driver circuitry, since driver costs are incurred in trying to optimize injector opening and closing performance.

With this system 10, injector calibration is not a factor in the metering of the system. Since the fuel quantity is measured at each step of the system, the delivery rate, either static flow, dynamic flow, or opening/closing times, is of little concern to the metering system. This translates to a large cost reduction in the injector 30 since the precision of metering orifices, needle lift, and return spring preload can be lessened, as can the testing and calibration costs associated with conventional injectors.

The pressure regulation method utilized by system 10 is less costly than fuel delivery applications of conventional systems, since absolute pressure is not required to be accurate. And since the system 10 measures delta pressure rather than absolute levels, the actual setting is less critical. The further implications of this method is that the pressure need not be constant, and that the regulation system need not be referenced to the pressure in an intake manifold since pressure across the injector is of relatively little interest. This dependence on delta pressure also reduces the cost of a pressure transducer, since it does not have to measure absolute pressure. A relative (gage) pressure sensor is adequate for the system, and its offset value does not need to be calibrated in sensor manufacturing. Since delta pressures are measured, an accurate gain is required (usually inherent in sensor manufacture), but the subtraction inherent in delta pressure calculations makes offset disappear from the process. Offset is typically the quantity trimmed in the sensor calibration process.

In addition, the system 10 may include a throttle position sensor 46 and an engine temperature sensor 48 in communication with engine controller 36 providing throttle position information and engine temperature information, respectively, to the engine controller.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A fuel injection system for an engine having exhaust valve train drive means, the system comprising:

a compression spring connected to said exhaust valve train drive means for compression and expansion movement therewith;

a diaphragm fuel pump including:

a pumping chamber having a pump diaphragm driven by said compression spring, said pumping chamber including a fuel inlet passage having a check valve therein, an injector chamber in fuel flow communication with said pumping chamber and receiving fuel from said pumping chamber during cycling of said compression spring, said injector chamber including an accumulator and being connected with a fuel injector, a check valve between said chambers preventing fuel flow back into said pumping chamber;

a pressure sensor mounted for sensing fuel pressure in said injector chamber and operable to communicate the fuel pressure value in said injector chamber;

an engine controller receiving said fuel pressure value in said injector chamber for controlling fuel metering based upon the reduction in fuel pressure in said injector chamber during engine fuel injection; and timing means in communication with said engine controller for initiating fuel injection.

2. The fuel injection system of claim 1 wherein said timing means is a crankshaft position sensor.

3. The fuel injection system of claim 2 wherein said crankshaft position sensor is a crankshaft toothed wheel sensor including a magnetic pickup electrically connected to said engine controller.

4. The fuel injection system of claim 1 wherein said exhaust valve train drive means is an exhaust cam lobe.

5. The fuel injection system of claim 1 wherein said timing means is a camshaft position sensor.

6. The fuel injection system of claim 1 wherein said timing means uses peak pressure in the injector chamber to indicate engine timing.

7. The fuel injection system of claim 1 wherein pressure sensor is a pressure transducer that communicates a voltage proportional to pressure in said injection chamber, to said engine controller.

8. The fuel injection system of claim 1 including a throttle position sensor electrically connected to said engine controller.

9. The fuel injection system of claim 1 including an engine temperature sensor electrically connected to said engine controller.

10. A method for injecting fuel into an engine having exhaust valve train drive means, the method comprising the steps of:

providing a diaphragm fuel pump driven by the valve train drive means;

providing an injector chamber including an accumulator in fuel flow communication with the fuel pump for receiving fuel from the fuel pump during cycling of the engine;

sensing fuel pressure in said injector chamber;

communicating the fuel pressure value in the injector chamber to an engine controller; and controlling fuel metering based upon the reduction in fuel pressure in the injector chamber during engine fuel injection.

11. The method of claim 10 comprising the step of:

using peak pressure in the injector chamber to indicate engine timing and thereby initiate the fuel injection.

12. The method of claim 10 comprising the step of:

initiating fuel injection as a function of sensed engine cycle position.

13. A method for injecting fuel into an engine comprising the steps of:

providing a fuel pump operative in relation to engine cycle position;

providing an accumulator in fuel flow communication with the fuel pump and an associated fuel injector;

sensing fuel pressure in the accumulator;

communicating the fuel pressure value in the accumulator to an engine controller; and controlling fuel metering based upon the reduction in fuel pressure in the accumulator during engine fuel injection.

14. The method of claim 13 including the step of:

monitoring pressure decay in the accumulator during fuel delivery.

15. The method of claim 14 including the step of:

closing of the fuel injector to cut off fuel flow upon occurrence of a predetermined value of pressure decay in the accumulator.

16. The method of claim 13 including the step of:

using peak pressure in the accumulator to initiate the fuel injection.

* * * * *